United States Patent [19]

Smith et al.

[11] Patent Number: 4,457,450

[45] Date of Patent: Jul. 3, 1984

[54] NICKEL-ZINC ALLOY COATED DRAWN AND IRONED CAN

[75] Inventors: John R. Smith, Richmond, Ohio; William D. Bingle, Rochester, Pa.; Lowell W. Austin, Weirton, W. Va.

[73] Assignee: National Steel Corporation, Pittsburgh, Pa.

[21] Appl. No.: 430,956

[22] Filed: Sep. 30, 1982

Related U.S. Application Data

[62] Division of Ser. No. 233,569, Feb. 11, 1981, Pat. No. 4,374,902.

[51] Int. Cl.[3] ..... B65D 1/12

[52] U.S. Cl. ..... 220/455; 220/456; 220/70; 220/DIG. 22

[58] Field of Search ..... 428/621, 674, 925, 926, 428/935, 603, 684, 681, 680, 624; 148/6.2, 31.5; 72/42, 47; 204/38 R, 43 T; 220/456, 455, 70, DIG. 22

[56] References Cited

U.S. PATENT DOCUMENTS

| | | | |
|---|---|---|---|
| 2,748,068 | 5/1956 | Faust et al. | 204/43 |
| 2,989,446 | 6/1961 | Hammond et al. | 204/41 |
| 3,245,885 | 4/1966 | Asano et al. | 204/35 |
| 3,295,936 | 1/1967 | Asano et al. | 29/183.5 |
| 3,360,157 | 12/1967 | Bolt et al. | 220/64 |
| 3,558,442 | 1/1971 | Roehl et al. | 204/28 |
| 3,655,349 | 4/1972 | Shah et al. | 29/196.4 |
| 3,703,448 | 11/1972 | Clauss et al. | 204/40 |
| 3,820,368 | 6/1974 | Fukuzuka et al. | 72/47 |
| 3,849,176 | 11/1974 | Asano et al. | 117/71 |
| 3,934,527 | 1/1976 | Saunders | 220/455 |
| 3,978,803 | 9/1976 | Asano et al. | 113/120 |
| 3,982,314 | 9/1976 | Ariga et al. | 220/455 |
| 4,104,133 | 8/1978 | Brannan et al. | 204/25 |
| 4,249,999 | 2/1981 | Tsuda et al. | 204/28 |
| 4,251,329 | 2/1981 | Asano et al. | 204/43 T |
| 4,329,402 | 5/1982 | Hyner et al. | 204/43 T |
| 4,331,517 | 5/1982 | Rechlicz | 204/43 T |

FOREIGN PATENT DOCUMENTS

| | | | |
|---|---|---|---|
| 57-149483 | 9/1982 | Japan | 204/43 T |
| 57-164999 | 10/1982 | Japan | 204/43 T |
| 719776 | 3/1980 | U.S.S.R. | 72/47 |

OTHER PUBLICATIONS

"The Deposition Potentials and Microstructures of Electrodeposited Nickel-Zinc Alloys", *The Electrochemical Society*, Lustman, B., Oct. 1943, pp. 47–59.

*Plating*, vol. 39, No. 9, pp. 1033–1037, Sep. 1952.

*Primary Examiner*—L. Dewayne Rutledge
*Assistant Examiner*—John J. Zimmerman
*Attorney, Agent, or Firm*—O'Neil & Bean

[57] ABSTRACT

An improved sheet steel suitable for the production of containers and the like has a thin composite coating of nickel and zinc plated on both sides thereof. The steel substrate may be flat rolled blackplate and the composite nickel-zinc coating may be plated thereon by drawing a running length or strip of the steel through a nickel electroplating bath to which has been added the necessary concentration of zinc, and electrodepositing the two coating metals simultaneously and in the desired proportions. The coated steel sheet is particularly useful in forming drawn and ironed cans although it may be used for other purposes.

6 Claims, 3 Drawing Figures

NICKEL-ZINC ALLOY COATED DRAWN AND IRONED CAN

This is a division of application Ser. No. 233,569, filed Feb. 11, 1981, now U.S. Pat. No. 4,374,902, the entire disclosure of which is incorporated herein by reference.

BACKGROUND OF THE INVENTION

1. The Field of the Invention

This invention relates to coated sheet steel and more particularly to an improved sheet steel having a thin coating of a nickel-zinc alloy electrodeposited on its surfaces. The invention also relates to an improved drawn and ironed can formed from sheet steel having a nickel-zinc alloy coating plated thereon.

2. Description of the Prior Art

Plated sheet steel is well known and widely used for various applications particularly where corrosion resistance is an important consideration. In the past, tin has been the most common coating metal and tinplate has been widely used particularly in the production of cans for food, beverages, and the like. The use of a chromium plated steel is also well known in the production of cans, and galvanized (zinc coated) steel and nickel plated steel has also been used for various purposes.

It is also well known to form containers, or cans, and particularly beverage cans, by the draw and iron process. This procedure involves drawing an initially flat metal blank into a cup having side and bottom wall thicknesses which are substantially equal, with the height of the cup being substantially less than that of the final can and the diameter being substantially equal to that of the finished can. The drawn cup is then supported on a punch or mandrel and forced through one or more ironing dies or rings whose inside diameter are each smaller than the outside diameter of the cup passing therethrough so that pressure between the ironing dies and the mandrel progressively reduces the thickness of the sidewall of the drawn cup and forces the metal along the mandrel to increase the height of the can.

In the past, difficulty has been encountered in forming drawn and ironed can bodies from uncoated flat rolled steel. The substantial forces required frequently resulted in tearing of the thinned sidewall, or pushing the mandrel through the can bottom. Thus, it has generally been found necessary to provide a coating of a softer metal such as tin on both sides of the steel base metal as a lubricating coating in order to successfully iron the sidewalls to the desired thickness.

It has generally been considered necessary to provide a coating of at leasat 0.25 pounds of tin per base box of steel (quarter pound plate) in order to assure reliable solderability of the components in a three-piece tin plate can. Coating weights at least as great as for three-piece containers have generally been found necessary to draw and iron tin plate containers, and half pound plate (0.50 pound tin per base box of steel) has been used to produce drawn and ironed tin-plated cans on a high-speed commercial production line. Half pound tin plate has a coating thickness of approximately 30 microinches on each side. This heavy tin coating greatly increases the cost of completed cans formed from tin plate. Further, in forming such drawn and ironed cans, there is a tendency for the tin to flow or be drawn from plateaus and deposited in valleys of the base steel surface, particularly during the ironig step, with the result that the thickness of the tin coating on the finished product varies widely.

Substantial effort has been made in recent years to provide a commercially acceptable alternative to the tin can, i.e., a can formed from tin plate. For example, chrome-chrome oxide coatings are widely used in the production of three-piece cans although it generally has not been considered possible to form a drawn and ironed container from such chrome-plated steel. U.S. Pat. Nos. 3,245,885 and 3,295,936 disclose the use of steel plate having a thin nickel coating, with the nickel coating being electrochemically treated in a solution of dichromate or chromic acid to deposit a thin film on the nickel to improve corrosion resistance and lacquerability. These patents also suggest substituting a nickel-iron or nickel-tin alloy for the thin nickel coating. The nickel coating is stated to be about 0.02 to 0.3 microns (about 0.8 to 11.8 microinches) in thickness, and the coated and treated steel material is stated to have anticorrosiveness, lacquerability and solderability about equal to that of tin plate. The '885 patent states that the coating is so thin that the workability is high.

U.S. Pat. No. 3,978,803 discloses a sheet steel material having a first layer of nickel or copper plated on its surfaces, with an outer layer of tin plated over the nickel or copper layer. The doubly-coated sheet steel is asserted to be useful in the forming of drawn and ironed cans.

It is common for small amounts of various metals to appear as impurities in continuous electroplating baths. For example, trace amounts of zinc are frequently present as an impurity in nickel plating solution. An article by D. T. Exing et al. appearing in the September, 1952 issue of *Plating* (*Plating*, Vol. 39, No.9, page 1033) reports the results of testing conducted at Michigan State College to determine the effects of zinc as an impurity in a nickel plating bath, and discusses procedures for removing the impurity from the bath. According to this article, the presence of zinc increases the hardness and adversely affects ductility of the nickel coating.

It generally has not been considered practical to form drawn and ironed containers from thin nickel coated steel on a high-speed commercial production line. While cans can be drawn and ironed from such material under laboratory conditions, experimentation has shown that numerous variables are so critical that they cannot always be reliably controlled to the extent necessary for successful high-speed commercial drawing and ironing line operation.

SUMMARY OF THE INVENTION

In accordance with the present invention, a steel sheet such as blackplate, has a thin, substantially uniform coating of a nickel-zinc alloy plated on both sides of the base metal. The coating may be within the range of about ½ to 5 microinches in thickness, and preferably about 1 to 3 microinches. The coating may contain zinc within the range of about 2 to 12 percent by weight, and preferably within the range of about 5 to 10 percent. The coating is applied by drawing a running length of the steel through a conventional nickel electroplating bath to which the desired amount of zinc has been added, preferably in the form of dried zinc sulfate ($ZnSO_4.H_2O$). The nickel-zinc coated steel may be chemically treated to increase storage life of the material and/or to enhance adhesion of organic coatings. Container bodies are drawn and ironed from the coated sheet steel to provide a low-cost, degradable container suitable for use in packaging foods and beverages.

Extensive experimentation has shown that the addition of zinc to the nickel coating materially facilitates ironing in the formation of drawn and ironed containers from the material. The inclusion of zinc in the amounts described does not adversely affect lacquerability, or the adhesion of the organic coating conventionally employed on the surface of cans such as those used in packaging of foods and beverages. Similarly, the nickel-zinc coated steel in accordance with the present invention may be employed for other uses where nickel coated steel alone has been employed. For example draw-redraw cans formed from the nickel-zinc coated steel have been used for packaging food and beverages and initial tests indicate that they may be at least equal or superior to chrome cans for at least some products.

DESCRIPTION OF THE DRAWINGS

The invention will be described hereinbelow with reference to the drawings, in which.

DESCRIPTION OF THE PREFERRED EMBODIMENT

In its broader aspects, the present invention involves electroplating a very thin coating 10 of a nickel-zinc alloy onto a thin sheet of steel to produce a coated steel product suitable for forming a one-piece drawn and ironed can body in a high-speed production can body-making line. The steel substrate 12 may be cold rolled mild steel such as blackplate having the same thickness and temper as is conventionally employed in tin plate used to form drawn and ironed cans. The nickel-zinc coated steel is then cut into blanks and formed into shallow cups by a drawing or draw-redraw operation. The sidewalls of the cups are subsequently ironed to reduce their thickness and increase their height to form the finished can bodies. Preferably the nickel-zinc alloy coating is electrochemically treated in a dichromate or chromic acid solution, or other suitable chemical solution, to apply a protective coating 14 which enhances the storage life of the plated steel. Also, a suitable lubricant such as ATBC is preferably applied to the chemically treated surfaces by suitable means such as an electrostatic lubricator known in the art. The nickel-zinc alloy coating on the steel substrate is very thin and may be in the range of about 0.5 to about 5.0 microinches, but preferably is within the range of about 1.0 to about 3.0 microinches in thickness.

Figure 3:
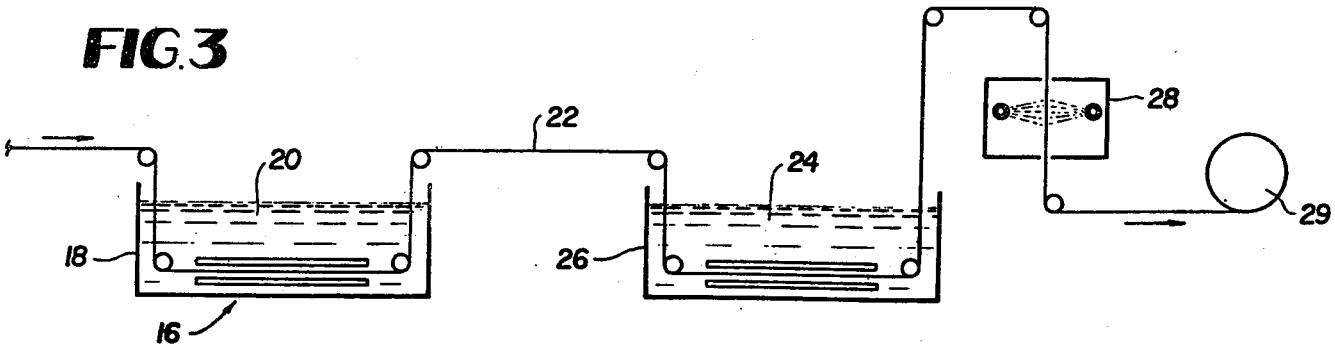
FIG. 3 is a schematic illustration of a high-speed plating line suitable for use in applying a nickel-zinc coating and chemical treatment to steel strip.
Figure 1:
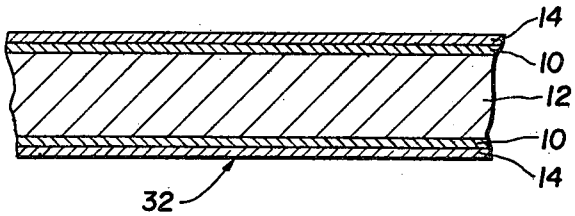
FIG. 1 is a fragmentary sectional view, on an enlarged scale, of a coated steel sheet embodying the present invention.

The extremely thin coating enables the nickel-zinc alloy to be applied at a high rate using conventional electroplating equipment and techniques. For example, a number of coils of steel strip have been coated on a nickel plating line such as the line indicated generally at 16 in FIG. 3 and including an electrolyte tank 18 containing 435 gallons of nickel electrolyte solution 20 into which varying amounts of dried zinc sulfate ($ZnSo_4.H_2O$) was added to give the desired zinc concentration. In this set up, one pound of $ZnSo_4.H_2O$ will result in approximately 100 PPM of zinc in the bath solution. Current densities and line speed of the steel substrate through the electrolyte bath are controlled in the conventional manner to produce the desired coating thickness and characteristics. The percentage of zinc in the nickel-zinc alloy coating is directly related to the concentration of zinc in the electrolyte solution. From the nickel plating bath, the running length of steel 22 may be passed through a chemical treatment bath 24 in tank 26 before being oiled as by an electrostatic oiler 28 and wound on a coil 29. The chemical treatment may be applied by a cathodic dichromate or chromic acid treatment process.

Figure 2:
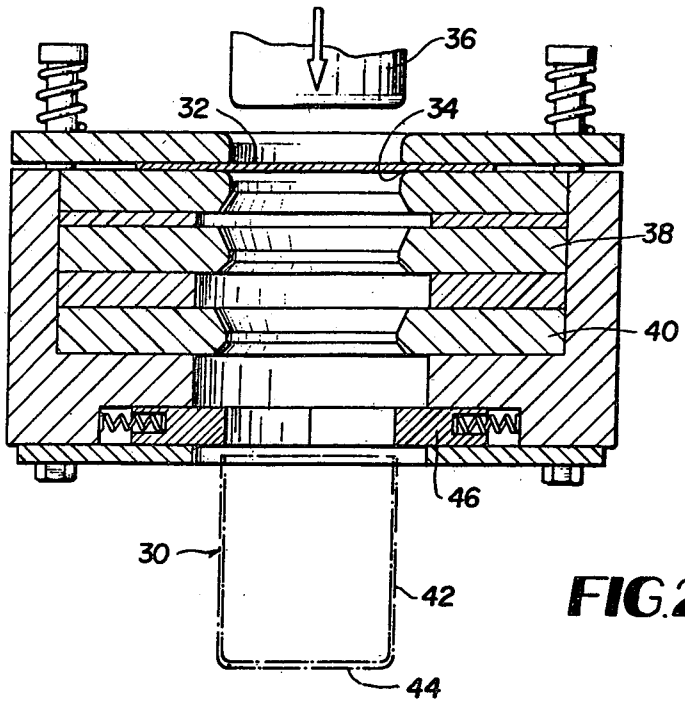
FIG. 2 is a sectional view of a conventional drawing and ironing die gang and punch illustrated in the process of drawing and ironing a can from a blank of sheet steel having a thin nickel-zinc coating plated thereon in accordance with the invention.

Referring to FIG. 2, drawn and ironed cans 30 may be formed by clamping cut blanks 32 adjacent an opening in a drawing die 34 and forcing the blanks through the die by a punch or mandrel 36 to initially draw the blanks into cups. The drawn cups can then be removed and ironed or redrawn then ironed in a separate apparatus or they may be ironed by a continued downward movement of the punch 36 to force the cups through a succession of ironing dies illustrated at 38, 40, with the successive dies engaged having progressively smaller openings so that each reduces the thickness of the sidewall 42 and increases the height of the cups to form the finished cans 30. The bottom wall 44 of the cans remain substantially the same thickness as the original blank 32.

After a can passes through the lowermost ironing die, the punch 36 can continue its travel until the top edge of the can passes a stripper 46. The stripper engages and strips the can from the punch upon its return stroke. The apparatus employed in the drawing and ironing operations can be conventional and accordingly is illustrated only schematically in FIG. 2.

In the drawing and ironing of tin plate to form drawn and ironed cans, relatively heavy coating thicknesses are required to provide the necessary lubricity to enable successful ironing. However, it has been found that extremely thin nickel-zinc coatings provided the lubricity to enable uniform ironing of the sidewalls of a drawn and ironed can. This is particularly surprising both because of the relatively hard nature of nickel and of the tendency of zinc to increase the hardness of a nickel coating. Further, contrary to expectation, it has been determined that an excessively thick nickel-zinc coating adversely affects the ability of the coated steel to be ironed on a high-speed bodymaker. Both excessively thick and extremely thin (e.g. below about 0.5 microinches) coatings present problems both in the ability of the material to be ironed without breaking and in the ability of the formed can body to be stripped from the ironing mandrel. Extremely thin and excessively thick coatings may also adversely affect the surface finish and brightness of the ironed sidewalls.

Since testing clearly established that beneficial effects are derived from the inclusion of zinc in a nickel coating for steel used for forming drawn and ironed cans, tests were also made in an effort to determine the effect of the inclusion of other impurities in the electrolyte coating bath. These tests included the addition of varying amounts of iron, tin and lead in a nickel plating bath, as well as the addition of varying amounts of nickel in a tin plating bath. Difficulty was experienced in obtaining a uniform composit coating of nickel and tin when nickel was added as an impurity, or second metal, in a tin electroplating bath. When low concentrations of nickel were used, the nickel did not plate out. When heavier concentrations were used, there was a tendency for the nickel to coat out in islands or concentrated nickel nodules. With tin as a minor element in a nickel plating bath, the tin did not plate out uniformly through the coating and the tin tended to quickly oxidize in the bath. Initial tests indicated that no substantial advantage was obtained from lead; however, in view of the undesirability of using lead in a food or beverage can, only limited testing was done using this metal.

Tests showed that steel having a relatively thin nickel-iron coating could be ironed more easily than uncoated steel, but the results were definitely inferior to those obtained by a nickel-zinc coating. Difficulties encountered in attempting to form drawn and ironed cans from the nickel-iron coated steel included an inferior surface finish, greater difficulty in stripping the ironed container form the ironing mandrel, and substantially increased wear on the ironing dies. There was also a tendency for iron to be picked up by the ironing dies, and this is believed to have contributed to the inferior surface.

A number of tests were conducted to evaluate the effect of various thicknesses of the nickel-zinc coating and the effect of the percentage of zinc in the coating. In conducting these tests, mild steel plate having a thickness, gage, temper and surface roughness suitable for use in forming tin plate for drawing and ironing cans was employed. Variations in surface roughness of the base steel sheet were also evaluated.

Evaluation of numerous tests conducted showed that the inclusion of zinc in the coating metal not only increased the ability of the coated steel to be drawn and ironed without breaking, but also contributed significantly to the appearance or surface finish of the finished product and the ability to satisfactorily strip the ironed can bodies from the mandrel on a high speed bodymaking machine. Best results were obtained with base steel having a surface finish, or roughness, of about 80 microinches, although surface finishes from 25 to 100 microinches were successfully employed.

Coating thicknesses below about ½ microinch were ineffective and, surprisingly, coating thicknesses above about 6 microinches produced markedly inferior results. Coating thicknesses of from 0.5 to 5 microinches produce satisfactory results, with best results being obtained with coating thicknesses between 1.0 and 3.0 microinches.

The percent of zinc used in the coating was also found to be critical, particularly on the low side. Thus, less than about 2 percent zinc in the coating did not produce results which were substantially better than obtained with pure nickel. Satisfactory results were obtained with zinc percentages within the range of 2 to 12, with best results being obtained when the coating contained 5 to 10 and preferably about 8.0 percent zinc. Zinc in excess of about 12 percent of the total coating weight produced less favorable surfaces on the finished can body and resulted in greater difficulty in stripping the ironed can from the mandrel.

It was also noted that zinc in amounts greater than about 12 percent of the coating weight presented difficulties in plating. For example, there was a tendency for the finished coating to have an uneven, streaked appearance, and the zinc did not always plate out evenly. One sample containing approximately 55 percent zinc was tested and found to be unsatisfactory because of poor stripping and poor can surface finish.

In one test, 170,000 can bodies were successfully produced from nickel-zinc coated steel, using high-speed drawing and ironing apparatus. This test revealed a number of changes required in operation of the apparatus when drawing and ironing nickel-zinc coated steel when compared with tin plate. For example, clamping pressure in the cupping and the redrawing operations for nickel-zinc coated steel may be reduced to about half that used when running tin plate, and different lubricating problems are presented as a result of the greater hardness and higher coefficient of friction of the nickel-zinc coating.

While we have disclosed and described preferred embodiments of our invention, we wish it understood that we do not intend to be restricted solely thereto, but rather than we intend to include all embodiments thereof which would be apparent to one skilled in the art and which come within the spirit and scope of our invention.

We claim:

1. A nickel-zinc alloy plated steel can comprising,
a bottom wall and a seamless sidewall, said bottom and sidewalls being integrally formed by a drawing and ironing process whereby the sidewalls is ironed to a thickness substantially less than that of the bottom wall,
said can being drawn and ironed from a flat rolled steel sheet having a nickel-zinc alloy coating plated on each side thereof, the nickel-zinc coating having a thickness within the range of about 0.5 to about 5 microinches before being drawn and ironed, and the amount of zinc in the coating being within the range of about 2 to about 12 percent by weight.

2. The can according to claim 1 wherein the nickel-zinc alloy coating has a thickness within the range of about 1.0 to about 3.0 microinches before being drawn and ironed.

3. The can according to claim 1 wherein the amount of zinc in the nickel-zinc alloy coating is within the range of about 5 to about 10 percent by weight.

4. The can according to claim 3 further comprising a thin dichromate or chromic acid coating on the surface of the nickel-zinc alloy coating, said dichromate or chromic acid coating being applied by immersing the nickel-zinc alloy plated steel in a solution of the dichromate of chromic acid coating material before it is drawn and ironed.

5. The can according to claim 4 wherein said flat rolled steel sheet is blackplate.

6. The can according to claim 5 further comprising an organic lacquer coating applied to and cured on at least the inner surface of the can.

* * * * *